United States Patent [19]

Beinhaur et al.

[11] Patent Number: 4,960,391

[45] Date of Patent: Oct. 2, 1990

[54] HERMETICALLY SEALED ELECTRICAL BULKHEAD CONNECTOR

[75] Inventors: Ernest L. Beinhaur, Harrisburg; Joseph G. Porter, Mechanicsburg, both of Pa.

[73] Assignee: AMP Incorporated, Harrisburg, Pa.

[21] Appl. No.: 490,527

[22] Filed: Mar. 2, 1990

Related U.S. Application Data

[63] Continuation of Ser. No. 366,987, Jun. 16, 1989, abandoned.

[51] Int. Cl.[5] ..... H01R 13/533

[52] U.S. Cl. ..... 439/559; 439/935; 174/152 GM

[58] Field of Search ..... 439/559, 935; 174/152 GM

[56] References Cited

U.S. PATENT DOCUMENTS

| | | | |
|---|---|---|---|
| 3,290,639 | 12/1966 | Driemeyer | 439/935 |
| 3,398,391 | 8/1968 | Brishka | 439/559 |
| 3,685,005 | 8/1972 | D'Alessandro | 439/935 |
| 3,721,943 | 3/1973 | Curr | 439/935 |
| 3,999,830 | 12/1976 | Herrmann, Jr. et al. | 339/136 M |
| 4,003,620 | 1/1977 | O'Brien et al. | 439/935 |
| 4,457,575 | 7/1984 | Davis et al. | 339/143 R |
| 4,808,125 | 2/1989 | Waters et al. | 439/607 |
| 4,902,242 | 2/1990 | Davis et al. | 439/607 |

FOREIGN PATENT DOCUMENTS

| | | | |
|---|---|---|---|
| 1364800 | 5/1964 | France | 174/152 GM |

OTHER PUBLICATIONS

U.S. Army Source Control Drawing No. 11737795 Sheets 1-16, "Connector Receptacle Electrical," 5/19/88. U.S. Army Electronics Research & Development Command, Harry Diamond Laboratores, Adelphi, Maryland.

IEEE Transactions on Components, Hybrids, and Manufacturing Technology, vol. CHMT-7, No. 3, Sep. 1984; pp. 276-280, Kokini et al., "Estimating the Strength of Annular Glass-to-Metal Seals in Microelectronic Packages: An Experimental Study".

Article, "Glass-to-Metal Improved Yields and Quality Using Nitrogen-Based Atmospheres," Schmidt et al., pp. 208-212.

*Primary Examiner*—Gary F. Paumen

*Attorney, Agent, or Firm*—Anton P. Ness

[57] ABSTRACT

A housing for a hermetically sealed bulkhead connector is machined of an integral metal member to have a precisely planar bulkhead-engaging surface of a mounting section extending peripherally around a contact support section disposed within a hood section extending through a cutout of the bulkhead. The housing also is machined to have precisely planar surfaces of a contact support section to facilitate assembly of contacts precisely concentrically disposed in passageways through the support section and securing therein by glass seals to comprise a parallel contact array. The housing is free of joints between the several sections which could provide sites for breaching the hermetic nature of the housing. No steps are performed which involve impacting or striking the housing which could disturb the precise planarity of the several precisely machined surfaces. The contact positions may be identified by laser etched indicia.

2 Claims, 6 Drawing Sheets

HERMETICALLY SEALED ELECTRICAL BULKHEAD CONNECTOR

This application is a continuation of application Ser. No. 07/366,987 filed June 16, 1989, now abandoned.

FIELD OF THE INVENTION

The present invention relates to the field of electrical connectors and more particular to hermetically sealed bulkhead connectors.

BACKGROUND OF THE INVENTION

Electrical connectors are known which contain one or more contacts, which are mountable in cutouts of bulkheads to be matable with corresponding contacts of electrical connectors on opposite sides of the bulkheads. Such an interface connector must maintain a hermetic seal at the bulkhead cutout which survives substantial and rapidly changing differences in atmospheric pressure on both sides of the bulkhead, and maintain that hermetic seal at elevated and reduced temperatures over long in-service use and through many cycles of pressure and temperature changes, and also through rapid temperature changes such as is known as thermal shock.

One known type of interface connector utilizes a plate of an electrically conductive metal such as KOVAR iron/nickel/cobalt alloy (trademark of Carpenter Technology Corporation) in which the plate is disposed transversely within and directly soldered to a tubular outer housing, and the outer housing can include an annular flange portion soldered to the periphery of the bulkhead cutout. In hermetically sealed interface connectors incorporating a metal plate, the individual contact pins are commonly retained within passageways in the metal plate by glass or ceramic plugs which support the contacts and provided a hermetic seal between the contacts and the side walls of the passageways. The glass plugs commonly are of borosilicate glass which has a coefficient of thermal expansion which is matched or at least quite similar to that of the KOVAR alloy. In the manufacture of this type of connector several process steps are performed involving very high temperatures: to decarburize or drive off carbon from the metal; to form a thick enough oxide layer on the metal; and to melt the glass preforms in the plate passageways and about the contacts to form a hermetic seal with the oxide layer.

A standard type of connector mating interface is known wherein one of two mating rectangular-shaped connectors has a dielectric housing surrounded by and affixed within a metal shell having a D-shaped hood surrounding the plurality of contacts providing physical protection and EMI shielding to the contact sections extending outwardly from the connector housing, the D-shaped hood adapted to receive thereinto a corresponding D-shaped plug section of the housing of the mating connector, while the metal shell is electrically commoned with the metal shell of the mating connector. The D-shape provides polarization so that the connector can be mated in only one orientation, resulting in the individual contacts of one of the connectors being aligned with and mating with the appropriate contacts of the other connector. The metal shells also include transverse flanges extending outwardly at the ends of the mating interface of the connectors and containing apertures, enabling the connectors to be fastened together after mating such as by jackscrews or similar accessories.

One such D-shaped connector assembly is known which is specified by a standard known as MIL-C-24308C, in which a metal plate is utilized instead of a dielectric housing, and includes passageways containing the contacts utilizing glass plugs. The metal plate is of steel and is joined by brazing to the surrounding metal shell of brass, which are plated by tin over copper. The passageways are formed in the metal plate by drilling, and each passageway is identified by permanent visible indicia stamped into the metal plate to indicate the contact position. The contacts are ferrous alloy plated with gold over copper, and the glass is a compression glass. The connector must meet stringent performance requirements set forth in MIL-STD-1344A, regarding no mechanical damage, nor open circuits, nor leakage of air under pressure differential, after the connector in mated engagement with its mating connector is subjected to random vibration, mechanical shock, sinusoidal vibration, and temperature cycling; and the connector must meet a satisfactory dielectric withstanding voltage.

Where such connectors have two or more metal parts to be brazed or otherwise integrally joined together peripherally around the contact region of the metal plate, it is necessary that the abutting surfaces to be brazed be absolutely coplanar and abut at all locations surrounding the contact region, or weaknesses can result possibly leading to undesired leakage under pressure and especially at elevated temperature. Another necessity is that the metal-to-metal interface not permit leakage where the two metals have different coefficients of thermal expansion which may stress the brazed joint; this problem interrelates with the previously stated problem of non-coplanar abutting surfaces, in that where substantial brazing material is disposed between the incremental gaps at a location, the coefficient of thermal expansion of the brazing material itself can result in leakage when different from the coefficients of the adjacent metals. Further, there is the known problem of galvanic corrosion between different metals during in-service use which eventually could affect hermeticity.

One other concern is that during stamping of the visible indicia onto the surface of the contact region of the metal plate adjacent the respective contact passageways, the passageway walls may be incrementally deformed so that the passageway walls originally precisely drilled contain regions of less than nominal diameter at least adjacent the surface stamped, which can result in possible leakage sites after the hermetic glass plugs are formed surrounding and retaining the respective contacts extending through the passageways. Such deformities could also complicate assembly of the glass preforms into the passageways during contact loading. The stamping may also result in slight warping of the metal plate which may disturb the originally precisely axial alignment of the passageways and corresponding alignment of the contacts extending therethrough.

It is desired to provide a hermetically sealed connector which maintains a precisely planar metal engagement surface to abut and either be soldered to the bulkhead cutout, or be adapted to firmly sealingly engage the bulkhead entirely surrounding the cutout.

It is also desired to provide a hermetically sealed connector which maintains precise positioning and precise axial alignment of the contacts extending through the transverse metal plate.

It is further desired to provide that the contacts have concentric outer surfaces and the passageways have walls which are precisely concentric of a continuous nominal diameter therealong, and that the contacts be maintained precisely coaxial with respect to respective passageways so that all portions of the passageway walls are maintained a fixed minimum distance radially from the contact portions.

It is also further desired that the axes of the several passageways of the array are precisely perpendicular to the support plate so that the pins of the array are coparallel.

SUMMARY OF THE INVENTION

The present invention is an integral homogeneous metal housing for a hermetic connector, thus having no joint between separate metal parts. The housing is machined from a slug of cold-rolled steel to its final general shape, with each of the contact-receiving passageways then drilled to be precisely spaced and located, to have a precise continuously coaxial diameter and to be precisely perpendicular to the transverse plate portion of the metal housing. Further the contact position indicia are laser etched adjacent the respective passageways which results in no incremental deformation of the periphery of the passageway entrance nor warping of the transverse plate.

It is an objective of the present invention to provide an integral metal housing for a hermetic connector having no joints between metal parts.

It is also an objective to provide a housing of a single part of homogeneous metal having a unitary coefficient of thermal expansion and being free of all metal-to-metal interfaces or joints.

It is an additional objective to provide a metal housing for a hermetic connector which is elongated transversely with respect to the mating interface and the transverse forwardly and rearwardly facing abutment and contact-proximate surfaces thereof are respectively uniformly precisely planar.

It is a further objective to provide such an integral homogeneous metal housing which is machined to attain precisely planar transverse bulkhead-engaging surfaces.

It is yet a further objective of the present invention to substantially eliminate stamping and other impacting steps during fabrication once the basic housing shape is attained, thus eliminating the creation of incremental disturbances in the precise planarity of the transverse bulkhead-engaging surfaces of the housing or in the precisely concentric drilled passageway wall surfaces.

An embodiment of the hermetic connector of the present invention will now be described with reference to the accompanying drawings

BRIEF DESCRIPTION OF THE DRAWINGS

FIGS. 6A and 6B are perspective views of the housing of the connector of the present invention in which FIG. 6A is of the basic shape of the housing resulting from the machining, and in FIG. 6B insert holes have been drilled and tapped in the lateral flanges to receive threaded inserts, and the contact-receiving passageways have been drilled;

DETAILED DESCRIPTION OF THE PREFERRED EMBODIMENT

Figure 1:
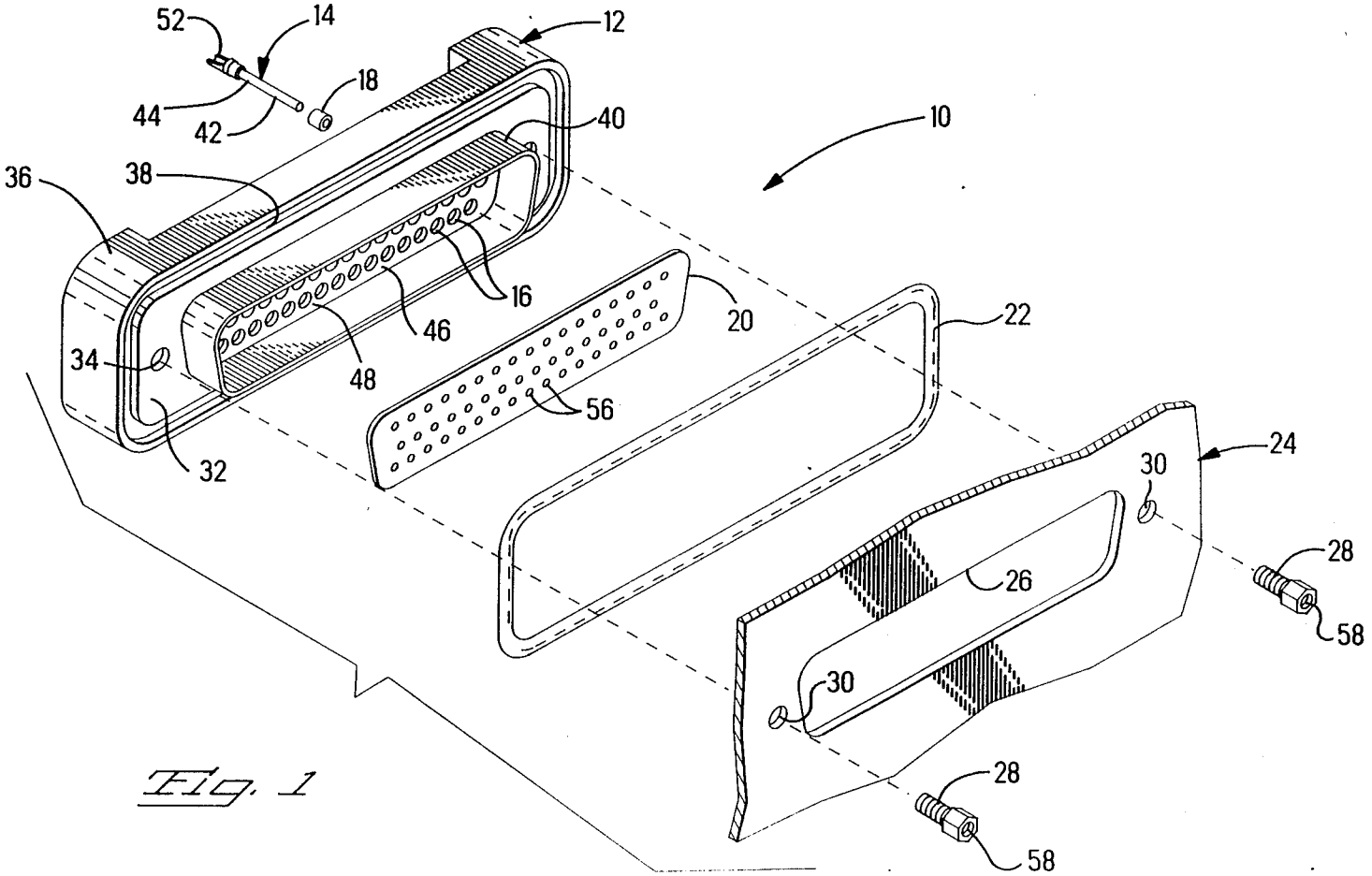
FIG. 1 is a perspective view of a hermetic sealed connector of the present invention exploded from a bulkhead at a cutout thereof.
Figure 2:
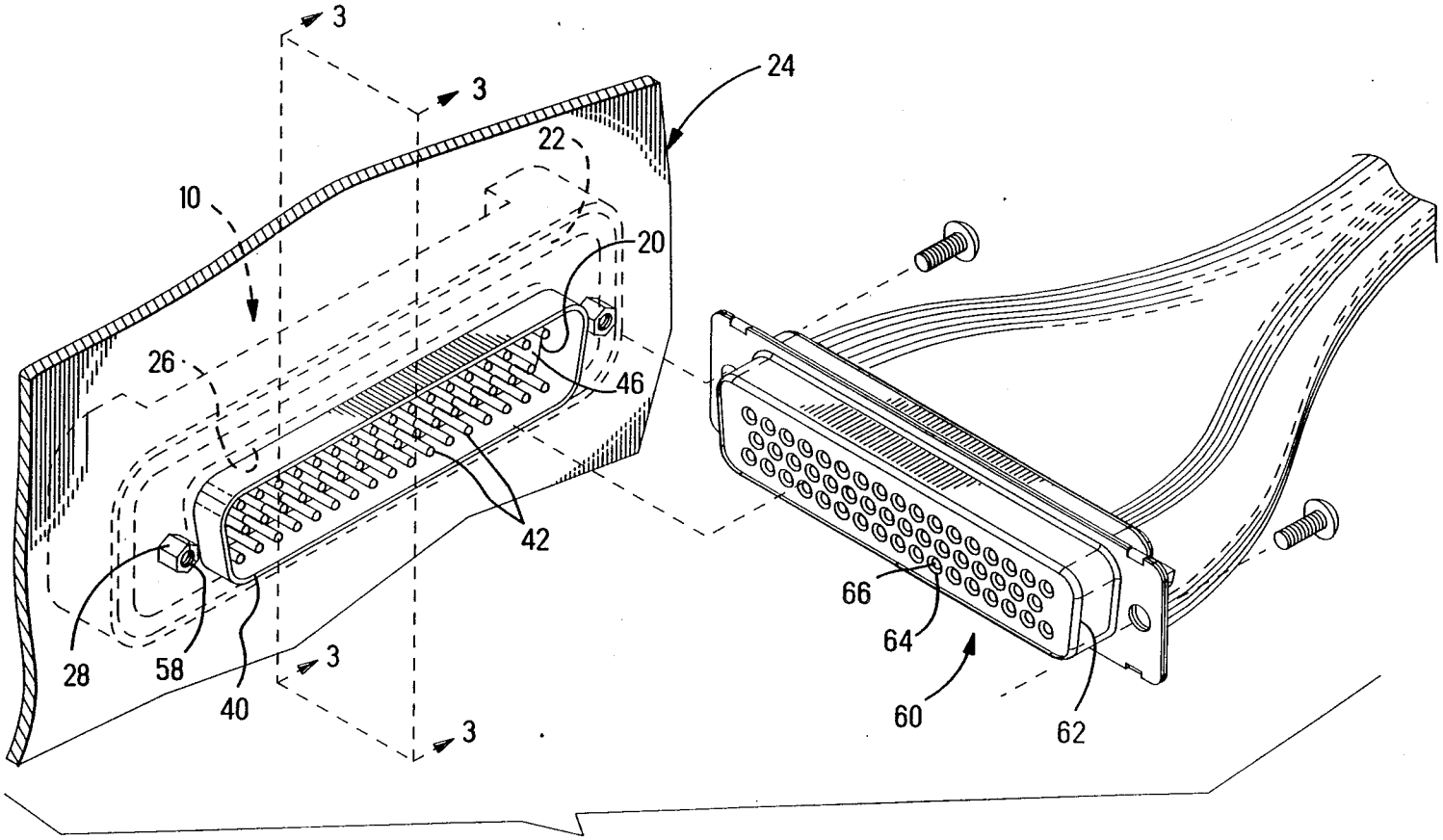
FIG. 2 is a perspective view of the connector of FIG. 1 and a mating connector.
Figure 3:
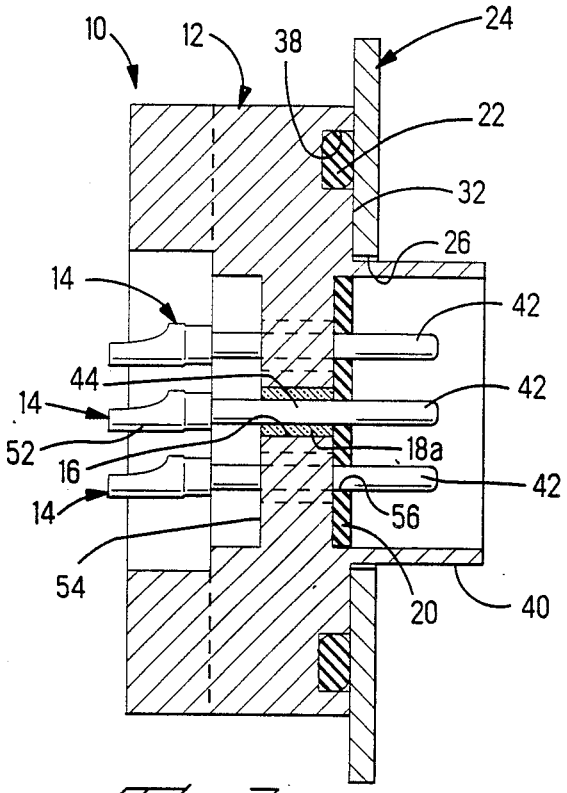
FIG. 3 is a longitudinal section view taken along lines 3—3 of FIG. 2.

Connector assembly 10 of FIGS. 1 to 4 includes a one-piece housing 12, a plurality of contacts 14 disposed within respective passageways 16 and held therein by respective glass preforms 18 which have been melted during fabrication of the assembly, an interfacial sheet 20 and a peripheral gasket ring 22, about to be mounted to a panel 24 at a cutout 26 by a pair of mounting screws 28. Mounting screws 28 extend through apertures 30 at ends of cutout 26 and into bulkhead-engaging surface 32 of housing 12 into threaded blind apertures 34 in mounting flanges 36 of housing 12. Gasket ring 22 such as of silicone rubber is disposed along and seated partially within a peripheral groove 38 along the bulkhead-engaging surface 32, and is compressed by the panel 24 upon connector 10 being mounted thereto, as seen in FIG. 3. Connector assembly 10 includes a forward hood section 40 extending through cutout 26 upon mounting, and contacts 14 each have a pin contact section 42 extending forwardly from cylindrical body section 44 and forwardly of housing mating face 46 and disposed in a pin array within and protected by forward hood section 40.

Figure 4:
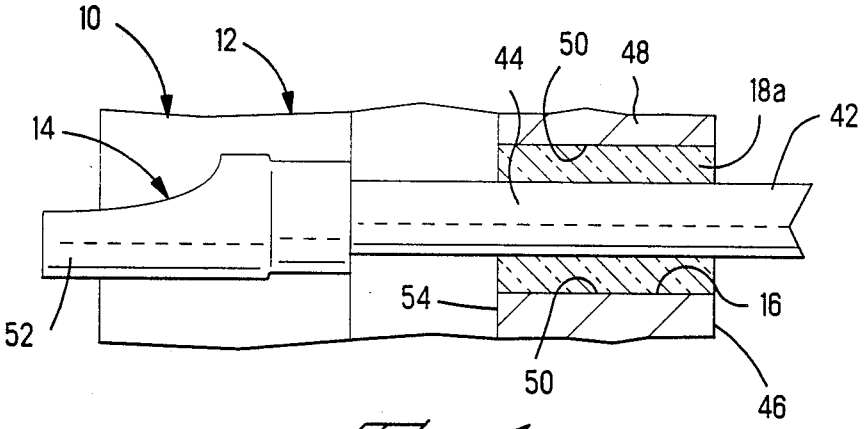
FIG. 4 is an enlarged section view of a contact location in the connector of FIG. 3.

Contacts 14 are preferably a nickel-iron alloy such as Alloy 52 and are mounted within passageways 16 of contact support section 48 of connector housing 12 by sleeve-like glass preforms 18 such as of CORNING 9013 compression glass (CORNING is a trademark of Corning Glass Works, Corning, N.Y.). After being melted and cooled, preforms 18 form glass seals **18*a* extending tightly between contact body sections 44 and side walls 50 of passageways 16 (FIG. 4). Each contact 14 is shown to have a solder socket section 52 such as of cold rolled steel secured such as by welding onto the rearward end of cylindrical body section 46 and extending rearwardly of rearward face 54 of housing 12; a stripped wire end of a conductor (not shown) will be inserted into solder socket section 52 and soldered Interfacial sheet 20 such as of silicone rubber is disposed along mating face 46 and includes a plurality of holes 56 through which extend respective pin contact sections 42, and sheet 20** serves to protect the glass seals from engagement with the mating connector.

In FIG. 2 connector assembly 10 has been mounted to panel 24 with forward hood section 40 extending through cutout 26, and a mating connector 60 is shown which has a forward plug section 62 shaped and dimensioned to be received into forward hood section 40 of connector assembly 10. To assure that the connectors 10,60 mate in the appropriate orientation, the forward hood section 40 may be D-shaped and the forward plug section 62 correspondingly D-shaped as is conventionally known for polarization. In passageways 64 are disposed respective socket contacts 66 electrically engageable with pin contact sections 42 of contacts 14 upon mating connector 60 being mated with connector 10. Connector 60 can be secured to connector assembly 10 when mated, if desired, by mounting screws extending through apertured shell flanges into threaded sockets 58 of mounting screws 28 which can be of the female screwlock type.

Figure 5:
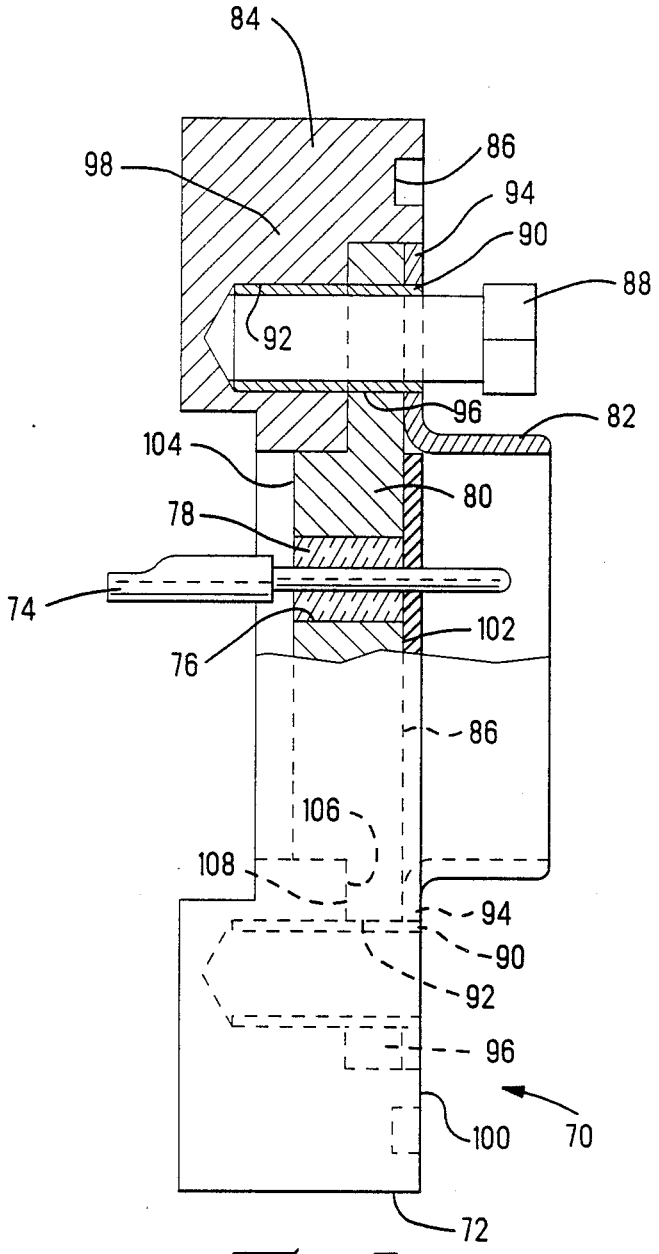
Fig. 5 PRIOR ART
FIG. 5 is a longitudinal part section view illustrating a bulkhead connector of the prior art, and showing the several parts thereof brazed or joined to each other, with a mounting screw in a mounting flange thereof.

FIG. 5 is a bulkhead connector 70 of the prior art, having a housing 72 having a plurality of contacts 74 disposed in passageways 76 and secured therein by glass seals 78 as is conventionally known. Housing 72 comprises a transverse contact support member 80, a hood member 82 and a peripheral mounting member 84, with mounting member 84 including a groove 86 into which a gasket ring will be disposed upon mounting to a bulkhead at a cutout by use of mounting screws 88 in threaded inserts 90 secured within apertures 92 into mounting flanges 94,96,98 of members 80,82,84 respectively. The gasket ring serves to maintain the seal around the cutout periphery between the transverse peripheral flange surfaces 100 of the mounting member 84 and the bulkhead surfaces. Contact support member 80, mounting member 84 and hood member 82 may all be of cold rolled steel No. 1010 or 1020. Glass seals 78 around each contact 74 extend through support member 80 from mating face 102 to rearward face 104 and therefore through the bulkhead Support member 80 is integrally joined to mounting member 84 peripherally around the contact region such as by brazing together the abutting interface surfaces 106 of support member 80 and 108 of mounting member 84. A joint therefore extends from rearward face 104 to the front of the connector housing 72 either at peripheral flange surface 100 or mounting apertures 92 in mounting flanges 96,98 containing threaded inserts 90. If all abutting surfaces are not integrally joined continuously at all locations along the interface 106,108, then hermeticity from one side of the bulkhead to the other is not assured. If brazing material is used, for example, it is believed that galvanic corrosion over time may degrade the hermetic nature of the joint. If the abutting surfaces are not exactly coplanar entirely around the periphery, then the brazed joint may be stressed unevenly during rapid temperature cycling, especially if the brazing material is somewhat thick at one point and has a different coefficient of thermal expansion than the joined metal parts. If the mounting apertures 92 through the mounting flanges 96,98 are not carefully formed after the mounting member 84 and support member 80 have been brazed, the formation of the aperture could damage the joint locally, enough to affect the hermeticity and allow leakage around the threaded insert.

Figure 6A:
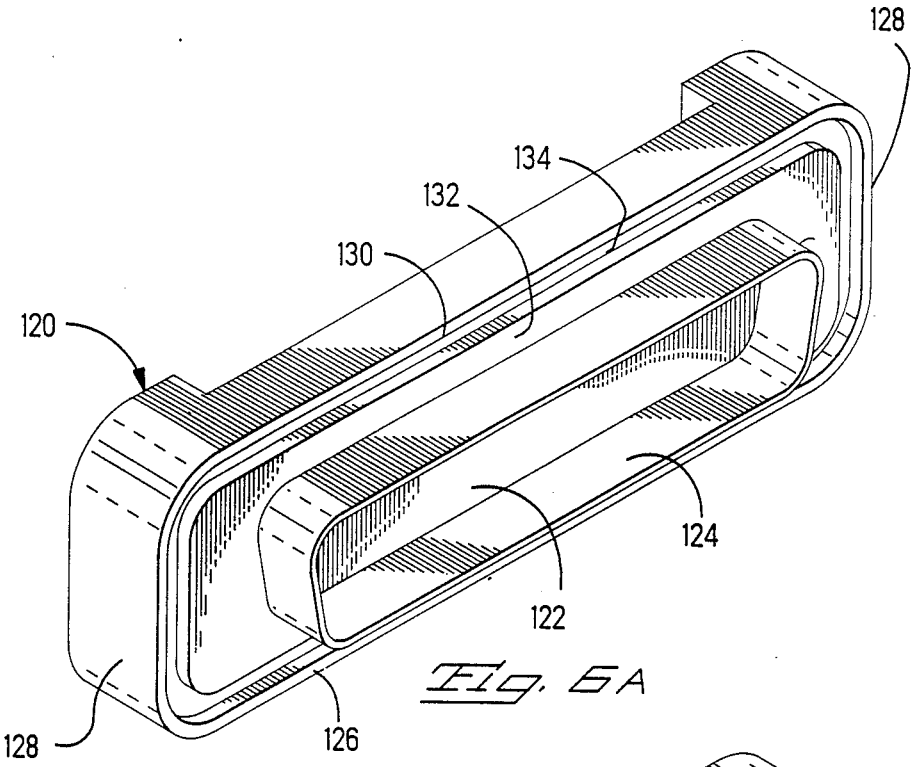
Figure 6B:
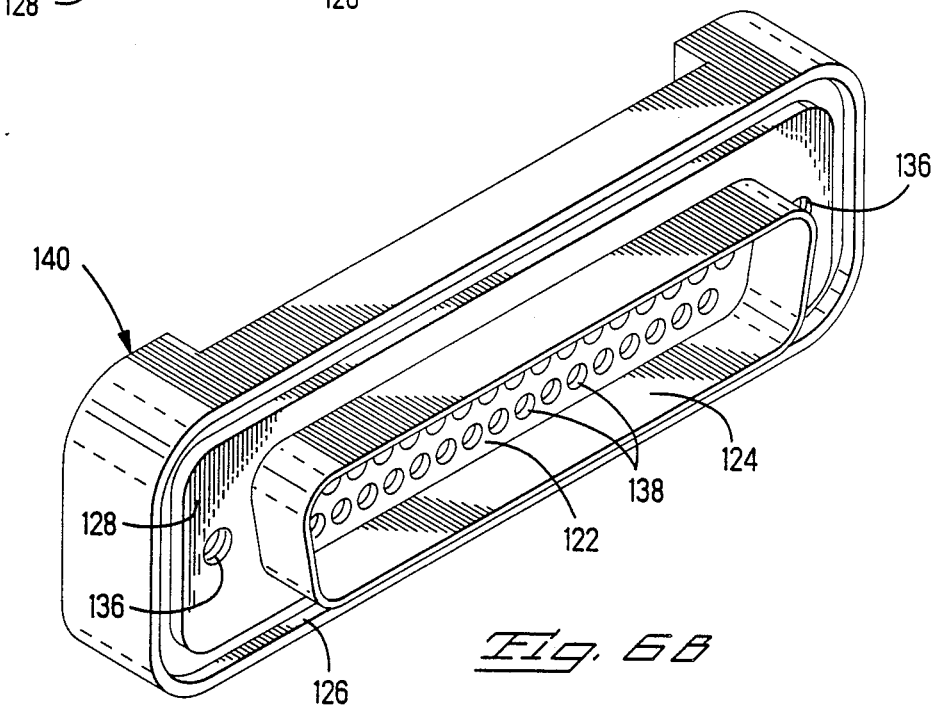

Connector housing 12, according to the present invention, is formed as an integral member as shown in FIGS. 6A and 6B. In FIG. 6A a preliminary unitary or integral (i.e. one-piece) body member 120 is formed from appropriate metal such as preferably cold rolled steel No. 1020 by machining to have a contact support section 122, a hood section 124 and a peripheral mounting section 126 all integrally joined to each other. Peripheral mounting section 126 includes mounting flanges 128 at lateral ends thereof and a precisely planar peripheral transverse flange section 130 defining a planar bulkhead-engaging surface 132 around hood section 124 including a gasket-receiving groove 134 machined thereon. Peripheral mounting section 126 has a greater axial dimension than contact support section 122 and extends rearwardly of rearward face 152 thereof. Bulkhead-engaging surface 132 is machined to achieve precise planarity peripherally surrounding hood section 124. As shown in FIG. 6B, mounting apertures 136 are drilled and tapped into relatively massive mounting flanges 128, after which threaded inserts (not shown) are secured therein which are adapted to receive threaded bulkhead; mounting screws thereinto When all machining and all secondary finishing steps have been performed on preliminary body member 120, contact passageways 138 are drilled into contact support section 122 at precisely located and spaced positions and having precisely axial centerlines and side walls, defining substantially complete connector housing member 140. It is preferred to remove the sharp edge surrounding the entrance of each passageway as a result of the drilling procedure, by machining an incremental chamfer (not shown) around the periphery no greater than 0.003 inches in width, as is known. Housing member 140 may then be nickel plated. Glass plugs 18 and contacts 14 (FIG. 1) are then secured in the respective passageways 16 through contact support section 122 of housing member 140 in the conventional very high temperature process needed to melt the glass.

Figure 7:
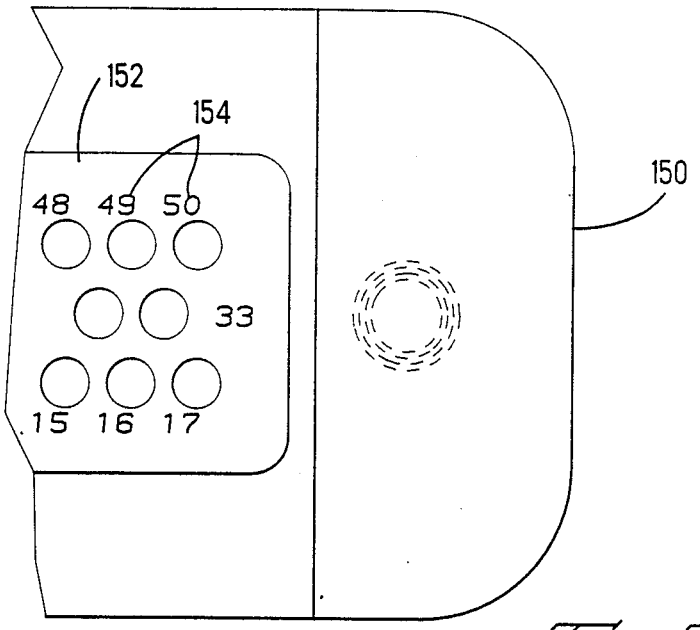
FIG. 7 is an enlarged view of the connector of FIG. 6B from rearwardly thereof showing the contact location indicia.

On bulkhead connectors generally, at least several of the contact locations are denoted on the rearward face 152 of a bulkhead connector 150 by visible indicia 154, as shown in FIG. 7. Such indicia have conventionally been imparted onto the surface, prior to contact loading, by striking the surface with an appropriately shaped punch. Such striking can commonly result in warping the contact support region and disturbing the axial alignment of the passageways, and such warping would at least complicate contact mounting and sealing and would lead either to unacceptable nonparallel contact alignment of the array or unacceptable nonconcentric positioning of the contacts within the passageways.

Figure 8:
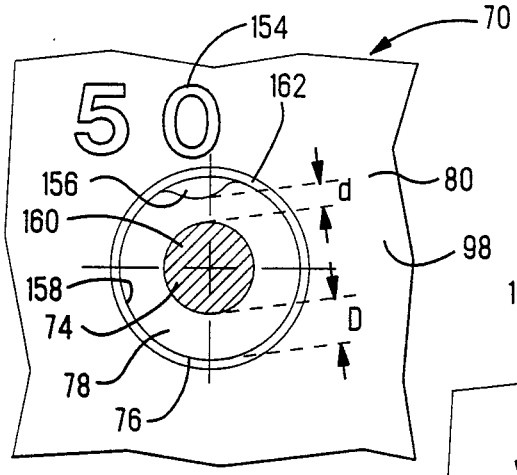
Fig. 8 PRIOR ART
FIG. 8 is a single contact location marked by stamping as in the prior art.

As shown in FIG. 8 Prior Art such striking can also easily cause deformity of the periphery of the entrance of the adjacent contact passageway 76, as at 156 which could extend along the passageway a small extent. Although depicted in exaggeration in FIG. 8, a region of less than nominal diameter is defined by the deformity 156, and the metal wall surface 158 of passageway 76 is a distance d which is slightly less than the nominal distance D from the outer surface 160 of a contact 74. The less-than-nominal distance d can commonly be 0.007 to 0.009 inches, where nominal distance D is 0.010 inches, for a passageway having a nominal diameter of 0.060 inches and the centered contact is 0.040 inches nominally; enough of a deformity can adversely affect insertion of the glass preforms or pin placement and alignment. While machining of a chamfer 162 0.003 inches in diagonal dimension could remove that portion of deformity 156 at surface 98, a special precision machining step may have to be performed to carefully abrade away remaining portions of the deformity inwardly from surface 98 without otherwise affecting the side walls of the carefully drilled passageway or removing necessary support for the glass seal at the entrance to resist torque on the contact after assembly; this step could be exceedingly difficult especially if the alignment of the previously drilled hole has been altered by contact support member having become warped.

Figure 9:
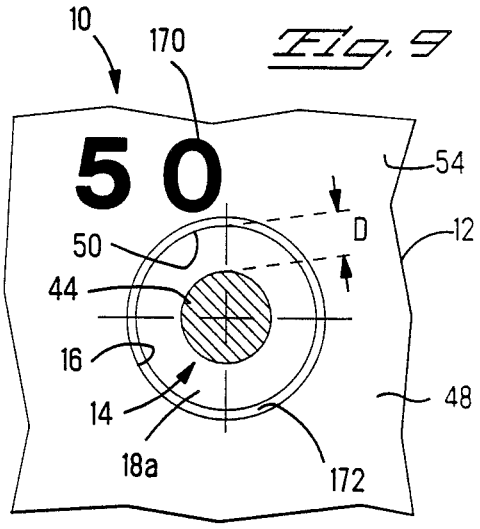
FIG. 9 is a single contact location marked by laser etching as in the present invention.

In the present invention as shown in in FIG. 9, visible indicia 170 are marked on the rearward surface 54 of connector housing 12 beside a passageway 16 by laser etching, which process does not deform the adjacent periphery of passageway wall surface 50 thereby maintaining the wall surface 52 of passageway 16 at nominal distance D . Small chamfer 172 is conventional.

The bulkhead connector housing of the present invention is thus manufactured to be an integral member having no joined interfaces between metal housing parts of a connector, and especially no joined interfaces in communication between the rearward surface and the mounting apertures containing the threaded inserts, which interfaces could provide sites for at least eventual microscopically breaching the hermetic seal. The process of manufacturing the connector housing of the present invention is adapted to eliminate steps which would disturb the planar nature of the surfaces which abut the bulkhead surface upon mounting, and which could disturb precise contact position and axial alignment and the precisely controlled nominal distance between the contact surface and the proximate passageway wall at all locations axially along the passageway.

The preferred embodiment has been described, and variations and modifications may be made thereto which are within the spirit of the invention and the scope of the claims.

What is claimed is:

1. A housing for a non-circular hermetic bulkhead-mountable connector containing a plurality of electrical contacts extending in an elongate array through respective passageways from one side of a bulkhead to the other through a bulkhead cutout, the connector being of the type having a metal housing including a transverse metal contact support portion wherein the contacts are mountable during a very high temperature process within glass seals within the passageways for assured hermeticity, comprising:

a laterally elongate, one-piece metal housing member including a contact support section defining a mating face and a rearward face, a mounting section surrounding said contact support section and integral therewith, and a hood section extending forwardly from said contact support section and formed one-piece therewith to extend through said cutout and surrounding said mating face;

said contact support section being laterally elongate and including a plurality of passageways precisely axially therethrough to extend from said rearward face to said mating face within which said contacts are mountable within said glass seals in an elongate array and oriented precisely axially;

said mounting section defining a transverse, laterally elongate, forwardly facing bulkhead-engaging surface peripherally surrounding said hood section to engage corresponding surface portions of said bulkhead surrounding said cutout, said bulkhead-engaging surface including a gasket-receiving groove peripherally therearound to receive a compressible gasket member therein to be engaged by said corresponding bulkhead surface upon said housing being mounted to said bulkhead, said mounting section having an axial dimension substantially larger than the axial dimension of said contact support section and extending rearwardly of said rearward face of said contact support surface;

said mounting section further including flange sections at lateral ends thereof laterally of said hood section each including aperture means extending thereinto from said bulkhead-engaging surface to receive mounting means threadedly thereinto for mounting said housing to said bulkhead;

said one-piece housing member being further defined in that said bulkhead-engaging surface is machined to be precisely coplanar, said contact support section is machined to have precisely planar and parallel rearward and mating faces, said passageways are precisely drilled after all other machining and finishing processes have been performed, and said member is free of impacting steps at least subsequent to machining of said surfaces, whereby the integral housing member is free of brazing or other joints which commonly provide sites for breaches in the hermetic seal during in-service use, and the thicker integral mounting section peripherally surrounding the elongate contact support section resists warping thereof during the very high temperature contact mounting process, and the forwardly extending integral hood section resists warping between the relatively massive rearwardly extending flange sections at lateral ends of the connector during the very high temperature contact mounting process, preserving the precise planarity of the contact support section and enabling and preserving precise axial alignment of the contacts and preserving the precise planarity of the bulkhead-engaging surface, thereby assuring the hermetic properties of the connector during in-service use.

2. A housing as set forth in claim 1 wherein at least selected ones of several positions of said contacts are each identified by indicia laser etched onto at least one of said mating and said rearward faces of said contact support section.

* * * * *